US009687136B2

(12) United States Patent
Boyer

(10) Patent No.: US 9,687,136 B2
(45) Date of Patent: Jun. 27, 2017

(54) TURBINE FLUID DIVERTER FOR AN APPLIANCE

(71) Applicant: General Electric Company, Schenectady, NY (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 413 days.

(21) Appl. No.: 14/481,954

(22) Filed: Sep. 10, 2014

(65) Prior Publication Data

US 2016/0066765 A1 Mar. 10, 2016

(51) Int. Cl.

| | |
|---|---|
| ***A47L 15/42*** | (2006.01) |
| ***F16K 31/16*** | (2006.01) |
| ***F16K 11/06*** | (2006.01) |

(52) U.S. Cl.

CPC ..... *A47L 15/4221* (2013.01)

(58) Field of Classification Search

CPC ..... A47L 15/4221; F16K 11/06; F16K 31/16
See application file for complete search history.

(56) References Cited

U.S. PATENT DOCUMENTS

| | | | | |
|---|---|---|---|---|
| 4,203,702 | A | 5/1980 | Williamson | |
| 7,100,623 | B2 | 9/2006 | Assmann et al. | |
| 8,522,810 | B2 | 9/2013 | Armstrong et al. | |
| 2004/0173249 | A1* | 9/2004 | Assmann | A47L 15/4221 134/94.1 |
| 2010/0043826 | A1* | 2/2010 | Bertsch | A47L 15/4221 134/18 |
| 2010/0078049 | A1* | 4/2010 | Assmann | F04D 15/0016 134/184 |
| 2012/0266924 | A1 | 10/2012 | Boyer et al. | |
| 2012/0291805 | A1* | 11/2012 | Tuller | A47L 15/4206 134/10 |
| 2013/0000762 | A1* | 1/2013 | Buddharaju | A47L 15/4221 137/605 |
| 2013/0319482 | A1* | 12/2013 | Vallejo Noriega | A47L 15/4285 134/99.1 |

(Continued)

FOREIGN PATENT DOCUMENTS

| | | | |
|---|---|---|---|
| IT | 1723888 A1 * | 11/2006 | A47L 15/4221 |
| JP | 2003339609 | 12/2003 | |

(Continued)

OTHER PUBLICATIONS

Turbine, Wikipedia Article, Jan. 26, 2017.*

*Primary Examiner* — Michael Barr
*Assistant Examiner* — Benjamin L Osterhout
(74) *Attorney, Agent, or Firm* — Dority & Manning, P.A.

(57) ABSTRACT

The present invention provides a dishwasher appliance and a diverter for a dishwasher appliance. The diverter uses a turbine powered by a flow of fluid from a pump to switch between different outlet ports. In a dishwasher appliance, fluid from the pump that, e.g., supplies one or more spray assemblies can be used to cause the diverter to switch between different fluid outlets and the different spray assemblies or other fluid-using elements. A separate motor to power the diverter or cycling of the pump to change the position of the diverter is not required, which allows a savings in energy usage, costs, and space.

20 Claims, 7 Drawing Sheets

(56) References Cited

U.S. PATENT DOCUMENTS

| | | | | |
|---|---|---|---|---|
| 2014/0069462 | A1* | 3/2014 | Becker | A47L 15/22 134/10 |
| 2014/0261560 | A1* | 9/2014 | Mealman | A47L 15/0052 134/25.2 |

FOREIGN PATENT DOCUMENTS

| | | |
|---|---|---|
| JP | 2007125124 | 5/2007 |
| JP | 2010264160 | 11/2010 |

* cited by examiner

TURBINE FLUID DIVERTER FOR AN APPLIANCE

FIELD OF THE INVENTION

The subject matter of the present disclosure relates generally to a diverter for an appliance.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

A dishwasher appliance is typically equipped with at least one pump for circulating fluid through the dishwasher appliance. Further, certain conventional dishwasher appliances use a device, referred to as a diverter, to control the flow of fluid in the dishwashing appliance. For example, the diverter can be used to selectively control which flow assemblies receive a flow of fluid. In one construction, the pump may be turned on and off to rotate an element of the diverter between different ports for fluid control. In another construction, the diverter uses an electrically powered motor to rotate the element between different ports for fluid control.

However, due to, e.g., wear on the pump and government regulations related to energy usage, it may not be desirable to repeatedly turn the pump on and off or provide a motor to control the diverter element. Moreover, the motor adds a significant expense to the overall manufacturing cost of the dishwashing appliance and must be separately controlled during cleaning operations so that the proper flow is occurring. Additionally, a dedicated motor for the diverter consumes that could otherwise be available in the dishwashing compartment for placement of dishes, glasses, silverware, and other items for cleaning.

Accordingly, a dishwasher appliance that can be configured to selectively control the flow through different spray assemblies or other fluid elements would be useful. Further, a diverter to control the flow through different spray assemblies or other fluid elements that does not require an electrically powered motor or cycling of the pump to operate would be beneficial. A diverter that allows constant changing of the flow through different spray assemblies or other fluid elements also would be advantageous.

BRIEF DESCRIPTION OF THE INVENTION

The present invention provides a dishwasher appliance and a diverter for a dishwasher appliance. The diverter uses a turbine powered by a flow of fluid from a pump to switch between different outlet ports. In a dishwasher appliance, fluid from the pump that, e.g., supplies one or more spray assemblies can be used to cause the diverter to switch between different fluid outlets and the different spray assemblies or other fluid-using elements. A separate motor to power the diverter or cycling of the pump to change the position of the diverter is not required, which allows a savings in energy usage, costs, and space. Additional aspects and advantages of the invention will be set forth in part in the following description, may be apparent from the description, or may be learned through practice of the invention.

In a first exemplary embodiment, a fluid flow diverter for a dishwasher appliance is provided. The fluid flow diverter includes a housing defining an inlet for the ingress of a flow of fluid into a diverter chamber and an outlet for the egress of fluid from the diverter chamber; a distribution plate defining a plurality of outlet ports, each outlet port defining a fluid flow path; a diverter disc positioned adjacent the distribution plate, the diverter disc defining a diverter aperture; a turbine wheel positioned in the flow of fluid from the inlet such that the flow of fluid causes a rotational motion of the turbine wheel about an axis extending perpendicular to a flow direction; and a plurality of gears for transmitting the rotational motion of the turbine to the diverter disc to rotate the diverter disc about an axis extending along the flow direction.

In a second exemplary embodiment, a dishwasher appliance is provided. The dishwasher appliance includes a tub that defines a wash chamber for receipt of articles for washing; a pump providing fluid flow for washing the articles; and a fluid flow diverter that receives a fluid flow from the pump. The fluid flow diverter includes a housing defining an inlet for the ingress of a flow of fluid into a diverter chamber and an outlet for the egress of fluid from the diverter chamber; a distribution plate defining a plurality of outlet ports, each outlet port defining a fluid flow path; a diverter disc positioned adjacent the distribution plate, the diverter disc defining a diverter aperture; a turbine wheel positioned in the flow of fluid from the inlet such that the flow of fluid causes a rotational motion of the turbine wheel about an axis extending perpendicular to a flow direction; and a plurality of gears for transmitting the rotational motion of the turbine to the diverter disc to rotate the diverter disc about an axis extending along the flow direction.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
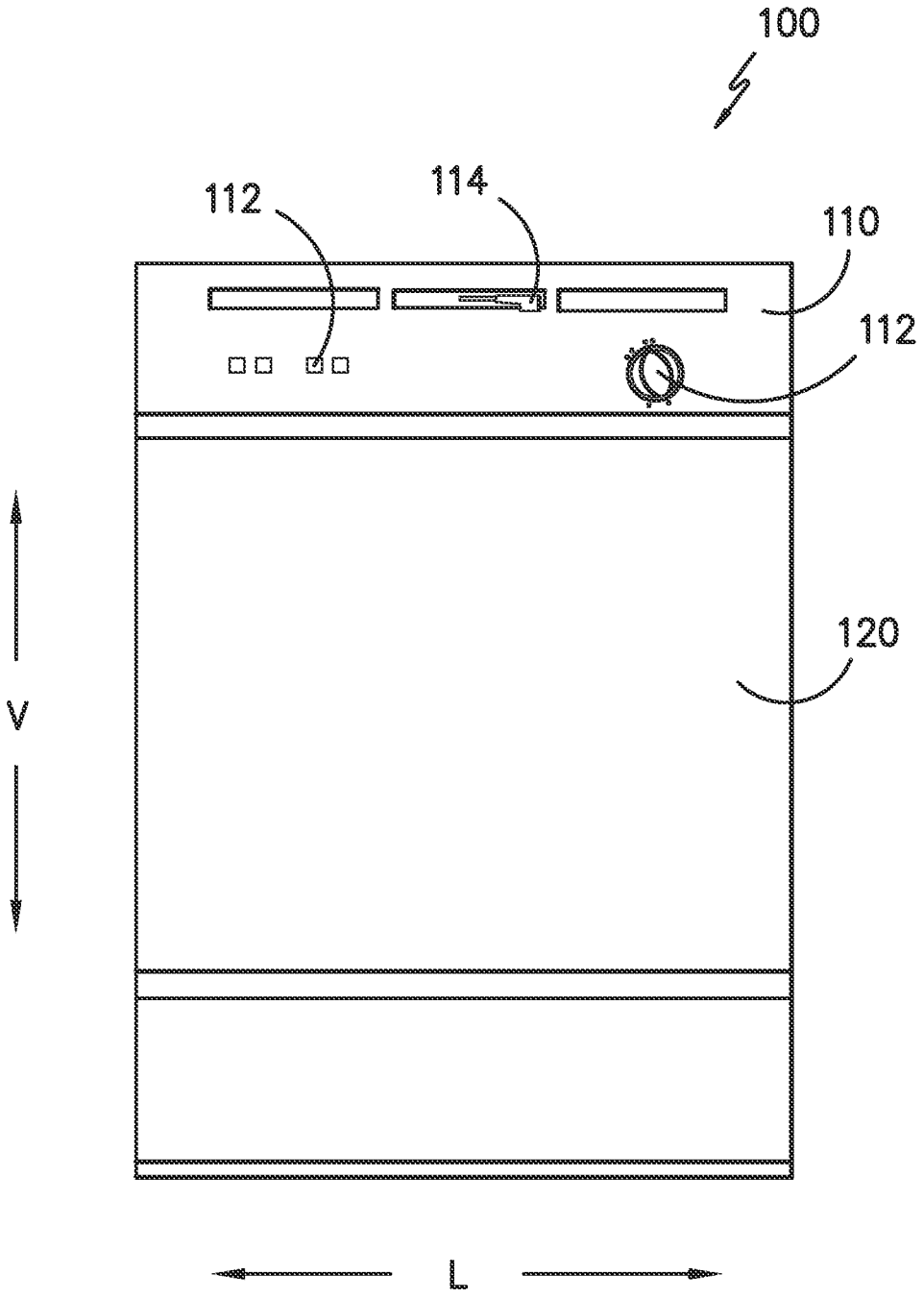
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
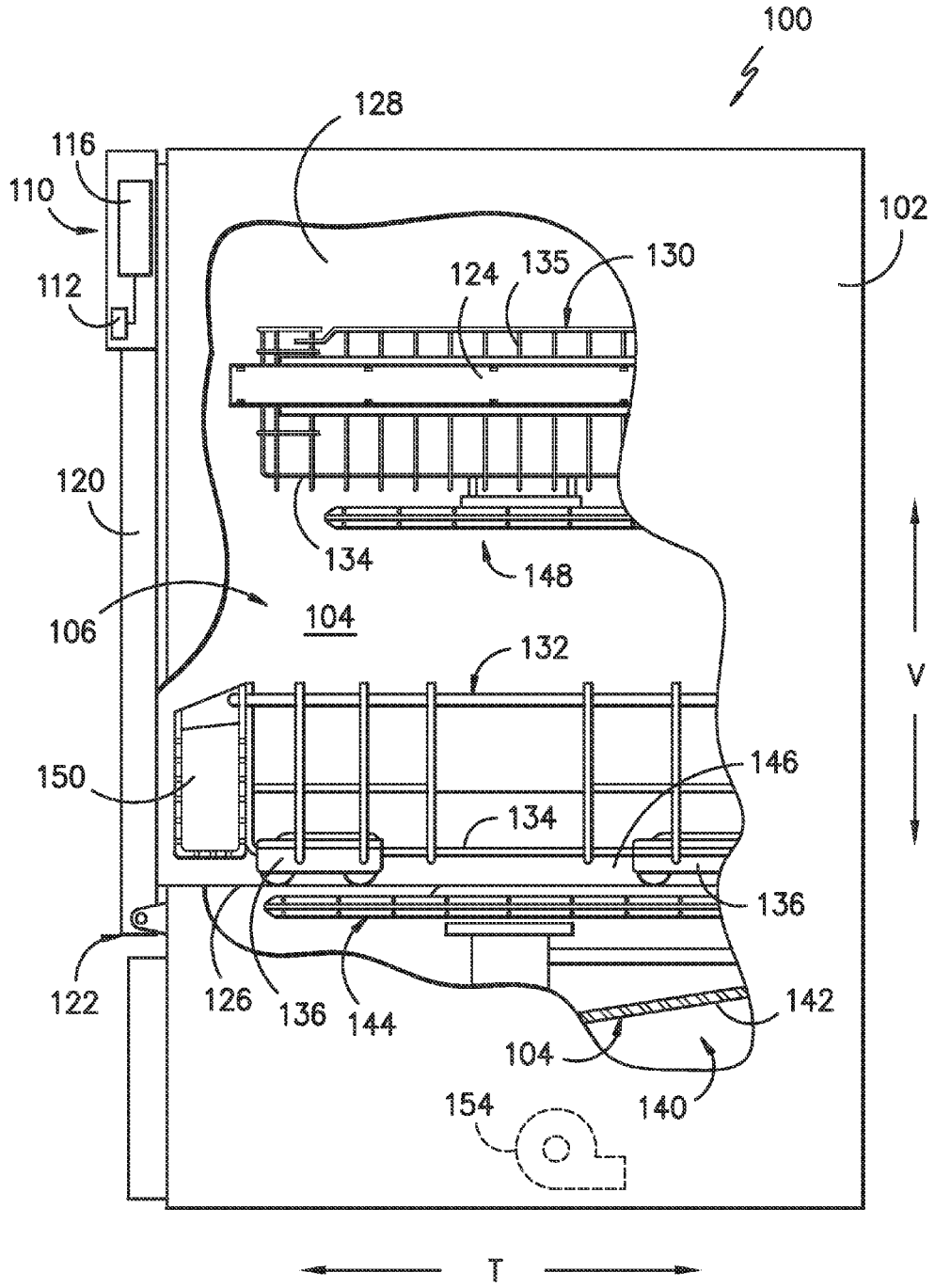
FIG. 2 provides a partial side section view of the exemplary dishwasher appliance of FIG. 1.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130 and mounted to an upper wall of tub 104. Other spray assemblies, such as, e.g., a bottle blaster spray assembly or a silverware wash spray assembly, may also be used.

Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Lower and mid-level spray assemblies 144, 148 and the upper spray assembly are fed by a fluid circulation assembly for circulating water and wash fluid in the tub 104. The fluid circulation assembly also includes a pump 154 that, along with other portions of the fluid circulation assembly, may be located in a machinery compartment 140 located below tub sump portion 142 of tub 104, as generally recognized in the art. Pump 154 receives fluid from sump 142 and provides a flow to a fluid flow diverter 200 as more fully described below.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. Further, user interface panel 112 may include input components, such as one or more of a variety of electrical, mechanical or electro-mechanical input devices including rotary dials, push buttons, and touch pads. Additionally, user interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for user interface 112, different configurations may be provided for upper and lower rack assemblies 130, 132 and/or lower and mid-level spray assemblies 144, 148, and other differences may be applied as well.

Figure 3:
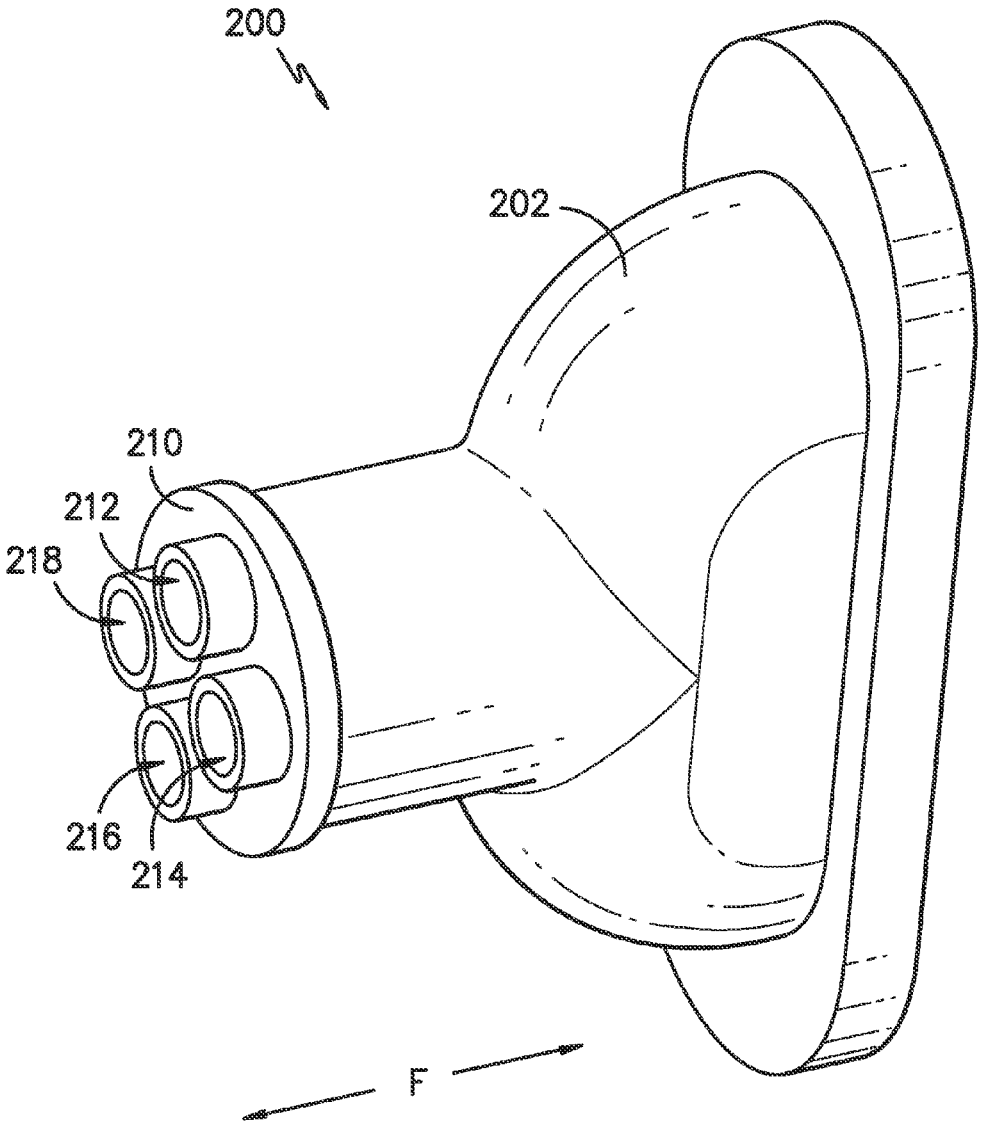
FIG. 3 provides a perspective view of an exemplary fluid flow diverter of the present subject matter.

FIG. 3 illustrates an exemplary embodiment of a fluid flow diverter 200. As shown, fluid flow diverter 200 includes a housing 202, which may be positioned adjacent, e.g., one of tub sidewalls 128 or any other appropriate component of dishwasher 100. Alternatively, diverter 200 may be positioned below sump 142. Housing 202 defines a diverter chamber 208 having an inlet 204 (FIG. 4) for the ingress of a flow of fluid FF from pump 154 that is to be supplied to spray assemblies 144, 148, and/or other fluid-using components of dishwasher appliance 100. Housing 202 further defines an outlet 206 for the egress of fluid flow FF from housing 202.

A distribution plate 210 positioned at outlet 206 defines a first outlet port 212, a second outlet port 214, a third outlet port 216, and a fourth outlet port 218. However, in other embodiments of the invention, two, three, or more than four outlet ports may be used with diverter 200 depending upon, e.g., the number of switchable ports desired for selectively placing pump 154 in fluid communication with different fluid-using elements of dishwasher 100. Diverter 200 includes a rotatable diverter disc 220 (FIGS. 4-6), more fully described below, that can be switched between ports 212, 214, 216, and 218 without using a separate motor or turning pump 154 on and off for such purpose. More particularly, disc 220 can be rotated so as to place its aperture 222 in fluid communication with any one of ports 212, 214, 216, and 218. As such, diverter 200 can be used to provide fluid flow from pump 154 through outlet ports 212, 214, 216, and 218 to switch the flow path of fluid from pump 154 to various fluid-using components of dishwasher 100.

By way of example, first outlet port 212 can be fluidly connected with an upper spray assembly, second outlet port 214 can be fluidly connected with mid-level spray arm assembly 148, and third and fourth outlet ports 216 and 218 might be fluidly connected with lower spray arm assembly 144. Other connection configurations may be used as well. As such, the rotation of disc 220 in diverter 200 can be used to selectively place pump 154 in fluid communication with spray assemblies 144, 148, or other fluid-using component by way of outlet ports 212, 214, 216, and 218.

Figure 4:
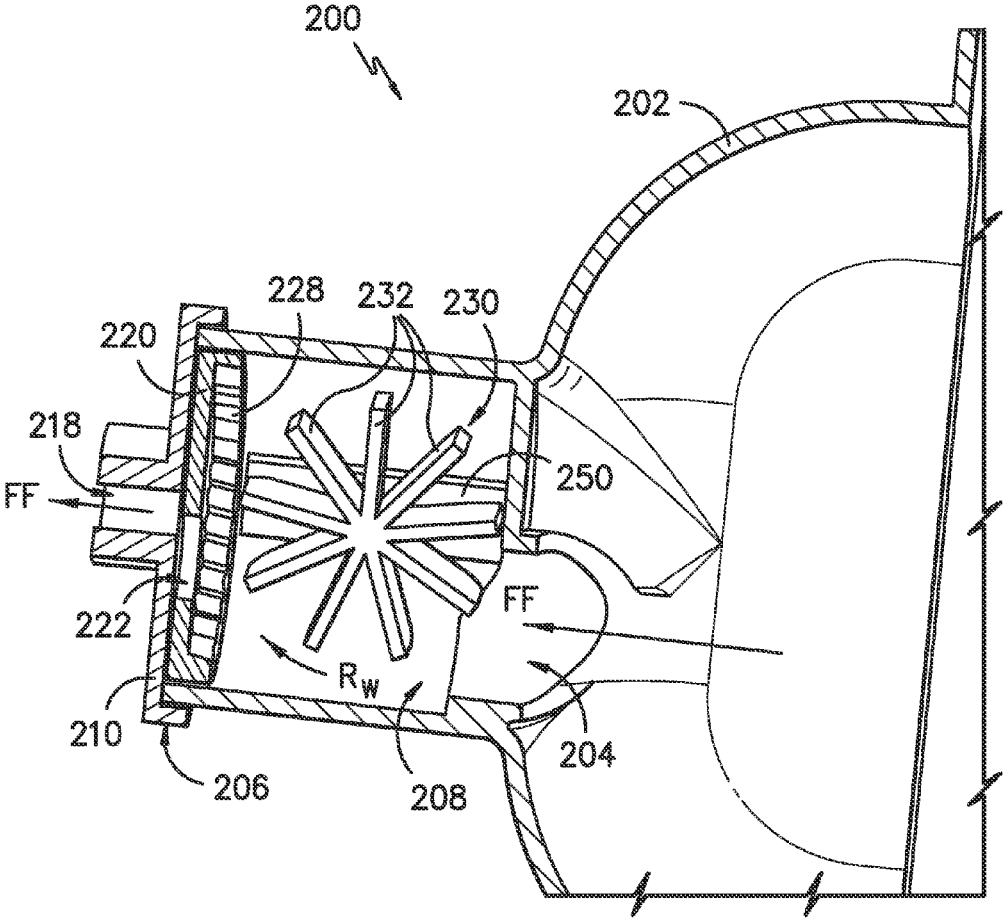
FIG. 4 provides a partial cross-section view of the exemplary fluid flow diverter of FIG. 3.

FIG. 4 illustrates a cross-section view of an exemplary fluid flow diverter 200. As shown, diverter disc 220 is positioned within diverter chamber 208 adjacent distribution plate 210. A turbine wheel 230 having a plurality of blades 232 is positioned within the flow of fluid FF entering diverter chamber 208 through inlet 204. Fluid flow FF against blades 232 causes turbine wheel 230 to rotate in a direction $R_W$ about an axis W. The rotation of turbine 230 is transmitted to diverter disc 220 to rotate disc 220 at a constant speed, as more fully described below. Thus, aperture 222 is displaced at a constant rate such that the egress of fluid flow FF from diverter chamber 208 is constantly changed between outlet ports 212, 214, 216, 218. In this way, fluid flow FF may be diverted through successive outlet ports 212, 214, 216, 218 as aperture 222 is displaced and switches the available fluid flow path between outlet ports 212, 214, 216, 218.

Figure 5:
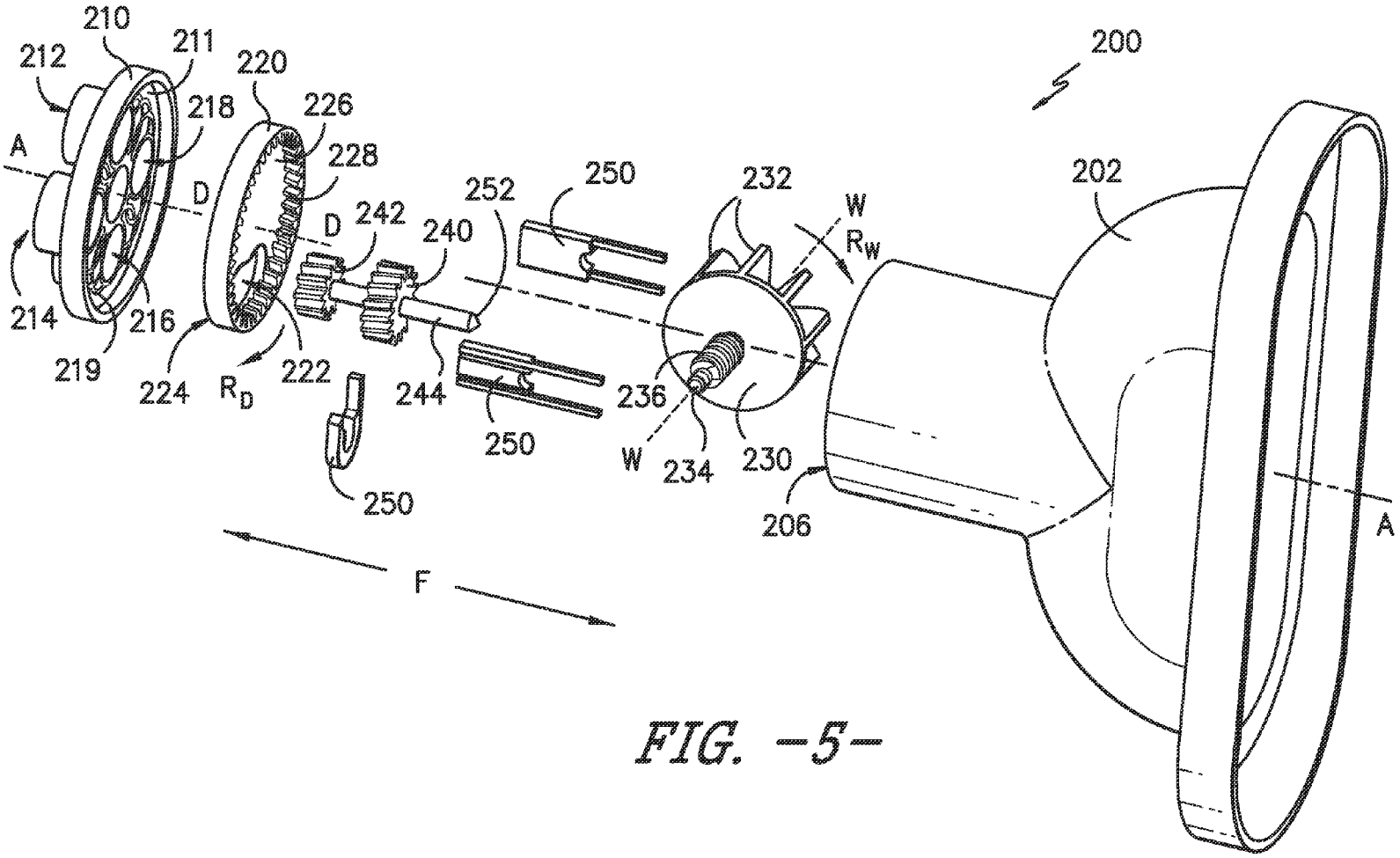
FIG. 5 provides an exploded view of the exemplary fluid flow diverter of FIG. 3.

Referring now to FIG. 5, an exploded view of an exemplary fluid flow diverter 200 is shown. As illustrated, distribution plate 210 includes an inner surface 211 having embossments 219 thereon. Diverter disc 220 includes a first side 224 and a second side 226, with second side 226 defining a ring gear 228. In alternative embodiments, ring gear 228 may be rigidly affixed to disc 220, or any other appropriate configuration of gear 228 may be used. When assembled within diverter chamber 208, first side 224 of disc 220 is adjacent inner surface 211 of distribution plate 210. Various support members 250 are provided to support and hold in place the components of diverter 200 within diverter chamber 208. The number, position, and configuration of support members 250 may vary as needed based on the configuration of the components of diverter 200.

Also as shown, fluid flow diverter 200 includes a plurality of gears to transmit the rotation of turbine wheel 230 to diverter disc 220. Turbine wheel 230 includes a shaft 234 extending perpendicular to a flow direction F and defining a worm gear 236. Alternatively, worm gear 236 may be rigidly affixed to shaft 234, or any other appropriate configuration of gear 236 may be used. Fluid flow diverter 200 also includes a first helical gear 240 and a second helical gear 242 affixed to a gear shaft 244. First helical gear 240 and second helical gear 242 are spaced apart along shaft 244, which extends along the flow direction F and may be supported by a support member 250. Additionally, shaft 244 may include a needle bearing 252 in contact with housing 202 and further supporting shaft 244. In the exemplary embodiment shown in FIG. 5, first helical gear 240 mates with worm gear 236, and second helical gear 242 mates with ring gear 228 defined by disc 220. Thus, through gears 228, 236, 240, 242, the rotational motion of turbine wheel 230 is translated to diverter disc 220 to rotate disc 220 in a direction $R_D$ about an axis D, which extends parallel to the flow direction F. The rotation of diverter disc 220 allows constant changing of the fluid flow path through diverter 200 by switching between outlet ports 212, 214, 216, 218 for the egress of the fluid from diverter chamber 208. Accordingly, fluid flow may be alternately provided to various components of dishwasher appliance 100, such as, e.g., spray assemblies 144, 148, without turning pump 154 on and off and without using a separate motor for such purpose.

Gears 228, 236, 240, 242 are selected such that disc 220 rotates at a desired rate. That is, the rate at which fluid flow is switched between the fluid-using components of dishwasher 100 by successively blocking and unblocking outlet ports 212, 214, 216, 218 may be determined, and the size and configuration of gears 228, 236, 240, 242 selected to achieve the determined rate. In some embodiments, the fluid flow FF entering diverter chamber 208 may be such that turbine wheel 230 rotates much faster than the desired rate of rotation of diverter disc 220. For example, turbine wheel 230 may rotate 200 times faster than diverter disc 220 and, thus, gears 228, 236, 240, 242 must be selected to reduce the rotational speed of wheel 230 such that disc 220 is rotated at the desired speed. Further, as shown, turbine wheel 230 rotates about axis W, which is perpendicular to a flow direction F, and diverter disc 220 rotates about axis D, which is parallel to flow direction F. As will readily be understood, other types, numbers, and configurations of gears with turbine wheel 230 and disc 220 also could be used to transmit the rotational motion of turbine wheel 230 to diverter disc 220 to change the fluid flow path between outlet ports 212, 214, 216, 218 at a desired rate.

Figure 6:
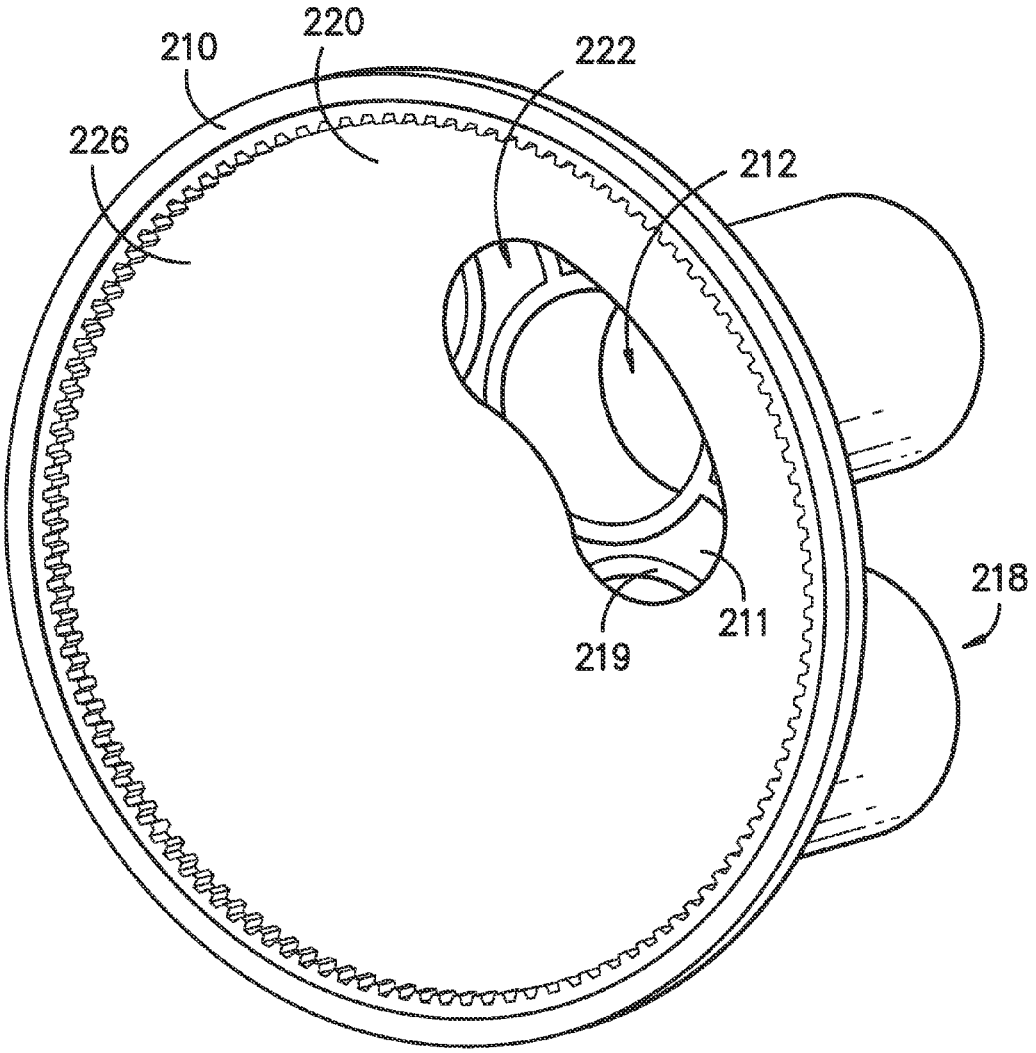
FIG. 6 provides a back, perspective view of an exemplary diverter disc and distribution plate of the exemplary fluid flow diverter of FIG. 3.

FIG. 6 illustrates a perspective view of diverter disc 220 and distribution plate 210. As shown, diverter aperture 222 has an elongated, noncircular shape such that at least a portion of an outlet port 212, 214, 216, 218 remains open as diverter disc 220 rotates and aperture 222 is displaced between outlet ports. That is, aperture 222 is shaped such that fluid flow FF is not completely blocked from exiting diverter chamber 208. Without fluid flow FF through fluid flow diverter 200, turbine wheel 230 could not rotate and, thus, disc 220 could not rotate to switch the fluid flow path between outlet ports 212, 214, 216, 218. Accordingly, diverter aperture 222 is shaped such that diverter disc 220 does not block fluid flow FF through diverter 200.

Figure 7:
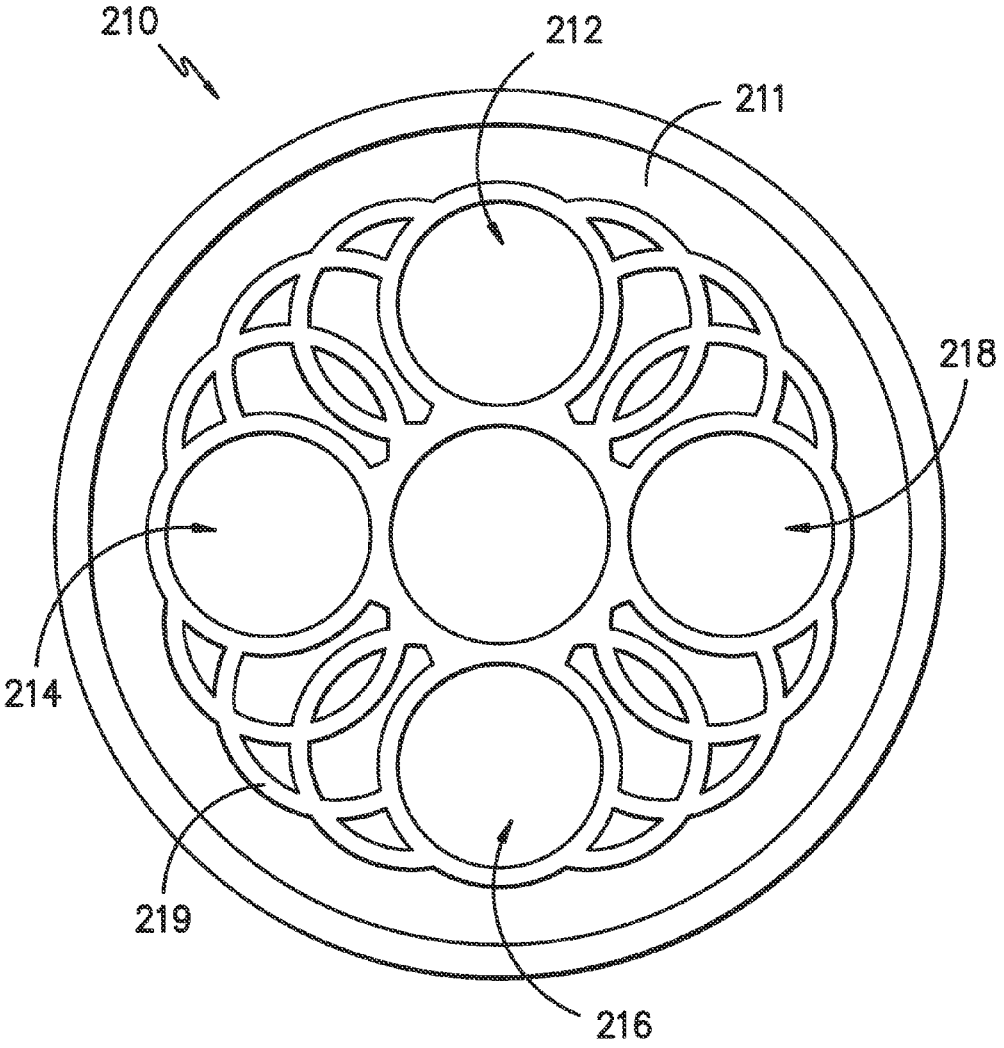
FIG. 7 provides a back, plan view of the exemplary distribution plate of FIG. 6.

Further, as shown in FIGS. 5-7, inner surface 211 of distribution plate 210 defines embossments 219. Embossments 219 decrease the contact area and increase the sealing force between distribution plate 210 and diverter disc 220. Embossments 219 may be provided in a pattern, as shown in, e.g., FIG. 7. Alternatively, embossments 219 may be provided in any other suitable configuration. For example, in some embodiments, embossments 219 may be provided on inner surface 211 only around the perimeter of outlet ports 212, 214, 216, 218.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A fluid flow diverter for a dishwasher appliance, comprising:

a housing defining an inlet for the ingress of a flow of fluid into a diverter chamber, the housing further defining an outlet for the egress of fluid from the diverter chamber;

a distribution plate defining a plurality of outlet ports, the distribution plate positioned at the outlet of the housing, the distribution plate having an inner surface defining embossments thereon;

a diverter disc positioned adjacent the distribution plate, the diverter disc defining a diverter aperture, the diverter disc having a first side and a second side, the first side adjacent the inner surface of the distribution plate and in contact with the embossments, the second side defining a ring gear;

a turbine wheel positioned in the flow of fluid from the inlet such that the flow of fluid causes a rotational motion of the turbine wheel about an axis extending therethrough; and a plurality of gears for transmitting the rotational motion of the turbine wheel to the diverter disc to rotate the diverter disc about an axis extending therethrough.

2. The fluid flow diverter of claim 1, wherein the diverter disc rotates at a constant rate to divert fluid through each outlet port in succession.

3. The fluid flow diverter of claim 1, wherein the diverter aperture is shaped such that, as the diverter rotates, at least a portion of an outlet port remains open for the egress of fluid from the diverter chamber.

4. The fluid flow diverter of claim 1, wherein the turbine wheel further comprises a plurality of blades positioned in the flow of fluid from the inlet.

5. The fluid flow diverter of claim 1, wherein the embossments are defined in a pattern of overlapping rings.

6. The fluid flow diverter of claim 1, wherein the plurality of gears comprises a worm gear defined by a shaft of the turbine wheel;

a first helical gear affixed to a gear shaft, the first helical gear mating with the worm gear;

a second helical gear affixed to the gear shaft, wherein the second helical gear mates with the ring gear.

7. The fluid flow diverter of claim 1, wherein the turbine wheel further comprises a shaft, and wherein one gear is affixed to the shaft.

8. The fluid flow diverter of claim 1, wherein the fluid flow diverter defines a flow direction, and wherein the axis of the turbine wheel extends perpendicular to the flow direction and the axis of the diverter disc extends parallel to the flow direction.

9. The fluid flow diverter of claim 1, wherein the distribution plate defines a first outlet port, a second outlet port, a third outlet port, and a fourth outlet port, each outlet port in fluid communication with a spray assembly of the dishwasher appliance.

10. A dishwasher appliance, comprising:

a tub that defines a wash chamber for receipt of articles for washing;

a pump providing fluid flow for washing the articles; and a fluid flow diverter that receives a fluid flow from the pump, the fluid flow diverter comprising a housing defining an inlet for the ingress of a flow of fluid into a diverter chamber, the housing further defining an outlet for the egress of fluid from the diverter chamber;

a distribution plate defining a plurality of outlet ports, the distribution plate positioned at the outlet of the housing, the distribution plate having an inner surface defining embossments thereon;

a diverter disc positioned adjacent the distribution plate, the diverter disc defining a diverter aperture, the diverter disc having a first side and a second side, the first side adjacent the inner surface of the distribution plate and in contact with the embossments, the second side defining a ring gear;

a turbine wheel positioned in the flow of fluid from the inlet such that the flow of fluid causes a rotational motion of the turbine wheel about an axis extending therethrough; and a plurality of gears for transmitting the rotational motion of the turbine wheel to the diverter disc to rotate the diverter disc about an axis extending therethrough.

11. The dishwasher appliance of claim 10, further comprising a plurality of spray assemblies, and wherein the fluid flow diverter controls the flow of fluid to at least a portion of the plurality of spray assemblies.

12. The dishwasher appliance of claim 10, wherein the diverter disc constantly rotates to divert fluid through each outlet port in succession.

13. The dishwasher appliance of claim 10, wherein the diverter aperture is shaped such that, as the diverter rotates, at least a portion of an outlet port remains open for the egress of fluid from the diverter chamber.

14. The dishwasher appliance of claim 10, wherein the turbine wheel further comprises a plurality of blades positioned in the flow of fluid from the inlet.

15. The dishwasher appliance of claim 10, wherein the embossments are defined in a pattern of overlapping rings.

16. The dishwasher appliance of claim 10, wherein the plurality of gears comprises a worm gear defined by a shaft of the turbine wheel;

a first helical gear affixed to a gear shaft, the first helical gear mating with the worm gear;

a second helical gear affixed to the gear shaft, wherein the second helical gear mates with the ring gear.

17. The dishwasher appliance of claim 10, wherein the turbine wheel further comprises a shaft, and wherein one gear is affixed to the shaft.

18. The dishwasher appliance of claim 10, wherein the fluid flow diverter defines a flow direction, and wherein the axis of the turbine wheel extends perpendicular to the flow direction and the axis of the diverter disc extends parallel to the flow direction.

19. The dishwasher appliance of claim 10, wherein the distribution plate defines a first outlet port, a second outlet port, a third outlet port, and a fourth outlet port, each outlet port in fluid communication with a spray assembly of the dishwasher appliance.

20. A fluid flow diverter for a dishwasher appliance, comprising:

a housing defining an inlet for the ingress of a flow of fluid into a diverter chamber, the housing further defining an outlet for the egress of fluid from the diverter chamber;

a distribution plate defining a plurality of outlet ports, the distribution plate positioned at the outlet of the housing, the distribution plate having an inner surface defining embossments thereon;

a diverter disc positioned adjacent the distribution plate, the diverter disc defining a diverter aperture, the diverter disc having a first side and a second side, the first side adjacent the inner surface of the distribution plate and in contact with the embossments, the second side defining a ring gear;

a turbine wheel including a shaft defining a worm gear, the shaft extending along an axis defined through the turbine wheel, the axis defined through the turbine wheel extending perpendicular to a flow direction, the turbine wheel positioned in the flow of fluid such that the flow of fluid causes a rotational motion of the turbine wheel about the axis defined through the turbine wheel; and a gear shaft including a first helical gear and a second helical gear spaced apart along the gear shaft, the first helical gear mating with the worm gear, the second helical gear mating with the ring gear, wherein the worm gear, first helical gear, second helical gear, and ring gear transmit the rotational motion of the turbine wheel to the diverter disc to rotate the diverter disc about an axis extending therethrough, the axis extending through the diverter disc extending parallel to the flow direction.

* * * * *